United States Patent [19]

Schultz

[11] Patent Number: 5,011,038

[45] Date of Patent: Apr. 30, 1991

[54] HOPPER CAR INLET OPENING PROTECTOR

[75] Inventor: Francis R. Schultz, Woodridge, Ill.

[73] Assignee: Salco Product Inc., Romeoville, Ill.

[21] Appl. No.: 498,430

[22] Filed: Mar. 26, 1990

[51] Int. Cl.[5] ..... B65D 45/32; B65D 39/04; B65D 39/16

[52] U.S. Cl. ..... 220/320; 220/319; 220/352

[58] Field of Search ..... 220/352, 319, 320, 214; 138/89, 96 R; 292/342

[56] References Cited

U.S. PATENT DOCUMENTS

| | | | |
|---|---|---|---|
| 1,914,409 | 6/1933 | Draper | 220/352 |
| 2,186,518 | 1/1940 | Buono | 220/319 |
| 3,148,798 | 9/1964 | Brown | 220/352 |
| 3,949,897 | 4/1976 | Shaw et al. | 220/352 |
| 4,143,789 | 3/1979 | Wade | 220/214 |
| 4,448,311 | 5/1984 | Houser | 220/319 |
| 4,499,353 | 2/1985 | Shields | 220/352 |

*Primary Examiner*—Stephen P. Garbe
*Assistant Examiner*—Paul Schwarz
*Attorney, Agent, or Firm*—Kinzer, Plyer, Dorn, McEachran & Jambor

[57] ABSTRACT

This invention concerns an inlet opening protector for use during maintenance operations on railroad hopper cars. The protector shields the coaming of a hopper car hatch and closes off the hatch opening. The protector includes a throat liner and a short liner. The throat liner has a frusto-conical skirt portion which defines interior and exterior edges. A radical flange is attached to the internal edge of the skirt. A plate member is attached to the external edge and covers the space defined by that edge. The surfaces of the skirt are tapered and sized to fit partially through the coaming. The short liner has a radial collar and an annular ferrule which fit around the skirt. The ferrule frictionally engages the coaming and the skirt to hold the throat liner in place in the inlet opening.

13 Claims, 1 Drawing Sheet

HOPPER CAR INLET OPENING PROTECTOR

BACKGROUND OF THE INVENTION

The present invention is an inlet opening protector for use on railroad hopper cars or other vessels having hatch openings. Hopper cars typically have a car body made of top, side and bottom walls. Interior partitions divide the car body into a plurality of compartments. Access to the compartments is provided by a plurality of hatches or openings in the top wall of the car body and by a bottom opening for each compartment. The bottom opening is normally closed off by an outlet gate. The inlet openings typically are defined by an upstanding wall referred to as a coaming. The coaming frequently, although not always, has a radial flange on its upper edge. The coaming is most often cylindrical, although it could be otherwise.

The inlet protector of the present invention is utilized during maintenance operations to prevent damage to the coaming and to isolate the car interior from the exterior. Maintenance operations on hopper cars can include sandblasting of the exterior to remove paint and scale and relining of the interior of the compartments. The protector of the present invention allows these operations to be performed simultaneously. The normal hatch cover is opened or removed during maintenance and the inlet protector installed. The protector forms a cover which closes the inlet opening and shields the coaming from shotblast and the like. It should be noted that access to the interior of the car is obtained through the bottom opening of the compartments because the outlet gate which normally closes off the bottom of the hopper is removed during these maintenance operations.

SUMMARY OF THE INVENTION

The protector of the present invention is formed of two main parts, a throat liner and a short liner. The throat liner has a frusto-conical skirt with a radial flange formed at an interior edge of the skirt. A plate member is attached to the exterior edge of the skirt and extends across the space defined by the exterior edge. The short liner is an annular ring having an axial ferrule and a radial collar. The ring fits around the exterior edge of the throat liner.

The throat liner is formed of flexible plastic material which allows it to be inserted through the inlet opening from the exterior of the car. A handle attached to the throat liner allows the user to pull the inserted liner back up into the coaming. The tapered side walls of the skirt are sized such that the throat liner is held in the coaming by a frictional contact initially at or near the bottom or interior of the coaming. Then the short liner is placed over the exterior portion of the throat liner. The axial ferrule of the short liner is forced into the space between the skirt and the coaming. Once so installed, the short liner protects the upper end and radial flange of the coaming. Inside the car the flange of the throat liner protects the interior edge of the coaming. This structure permits simultaneous sandblasting on the exterior of the car and relining or coating of the inside of the car since the functions are totally separated and isolated by the protector.

DETAILED DESCRIPTION OF THE INVENTION

Figures 1, 2, 3:
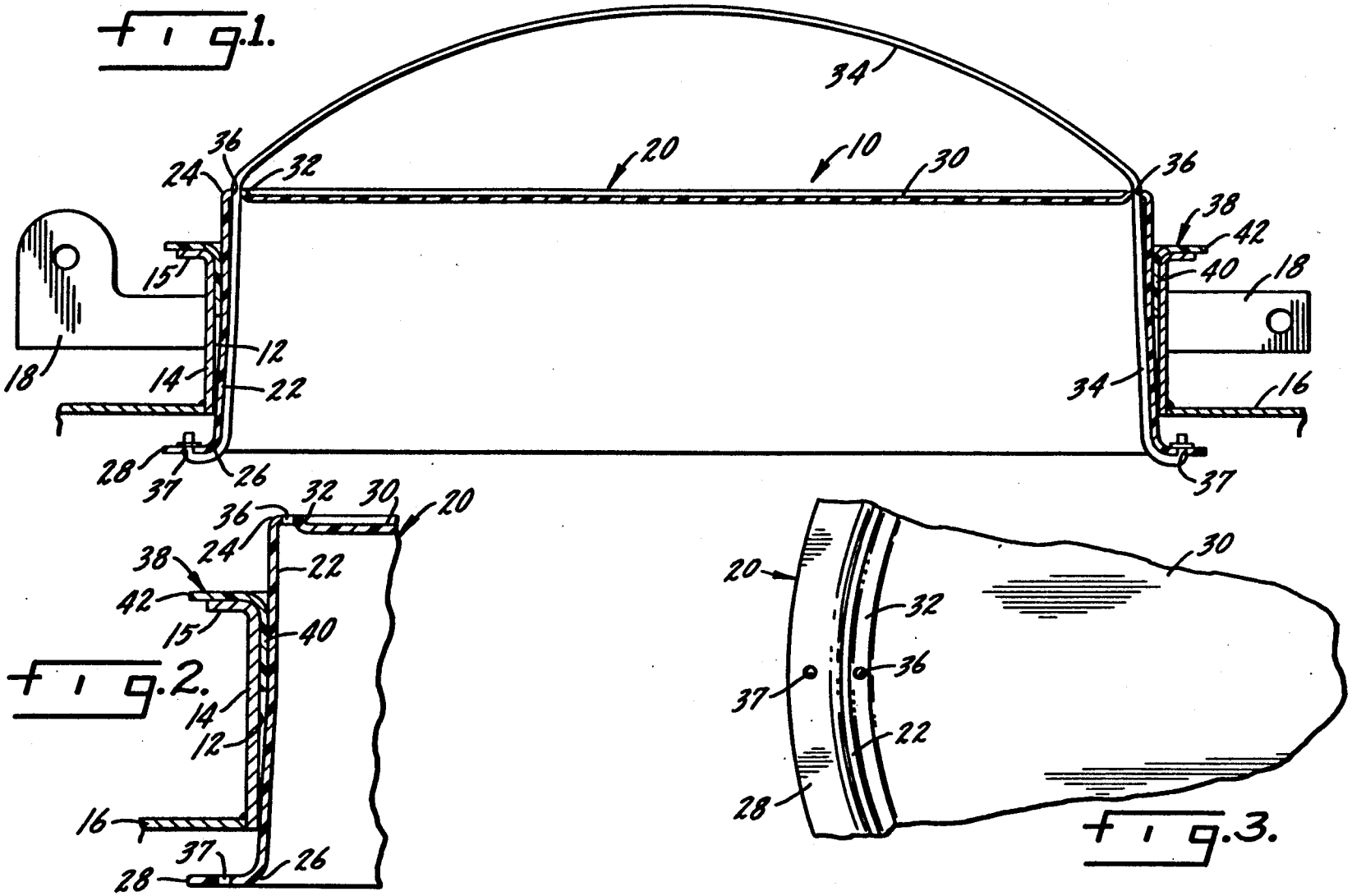
FIG. 1 is a section through a portion of a hopper car top wall and coaming, showing the inlet protector device of the present invention.
FIG. 2 is an enlarged, partial section illustrating the cooperation between the coaming and inlet protector device.
FIG. 3 is a partial, bottom plan view of the throat liner.

The inlet protector 10 of the present invention is illustrated in FIGS. 1 and 2, installed in an inlet opening 12, defined by a coaming 14. The coaming is attached to the top wall 16 of a compartment, such as a railroad hopper car. The upper end of the coaming has a radial flange 15. The coaming will typically also include brackets 18 for attachment of a hatch cover (not shown). The top wall 16 defines an interior and exterior portion of the compartment. In FIG. 1, the interior is underneath the wall 16 and the exterior is above the wall. The coaming 14 is most often cylindrical and defines an internal dimension which is conventionally an internal diameter, although it could be otherwise.

The protector 10 includes a throat liner indicated generally at 20. The throat liner has an annular skirt 22. The skirt has a height at least as great as the height of the coaming. In other words, when the throat liner is installed, the skirt will extend from the interior to the exterior of the compartment. For reference purposes only, the height of the skirt is about five and a half inches and the diameter is nominally twenty inches.

The skirt defines spaced first and second edges 24 and 26. The skirt is tapered such that the external diameter of the first edge 24 is less than the internal diameter of the coaming 14, while the external diameter of the second edge 26 is greater than the internal diameter of the coaming. Thus, the skirt has a frusto-conical shape. For reference purposes, the amount of taper or draft is about two degrees in the first four and a half inches from the first edge 24 toward the second edge 26. The last one inch has a thirty minute draft. Thus, it is seen that the skirt 22 has a compound taper with the break point approximately at the bottom edge of the coaming 14, as shown in FIGS. 1 and 2.

A radial flange 28 is attached to the skirt adjacent the second edge 26. The flange 28 extends radially outwardly from the skirt to an extent that its external diameter is greater than that of the coaming 14. Thus, when the throat liner is in position in the inlet opening, the flange 28 extends beyond the coaming 14.

The throat liner 20 further includes a plate member 30. The plate has an upraised boss 32 around its periphery. The boss 32 is connected to the skirt 22 near its first edge 24. The plate 30 is a solid member which extends across the annular space defined by the first edge 24 on the skirt. Thus, when the throat liner is installed in a coaming, the plate member 30 serves as a lid or cover which encloses the inlet opening 12.

The throat liner 20 further includes a handle means in the form of a nylon rope 34. The handle 34 extends through holes 36 in the boss 32 and continues along the inside edge of the skirt 22. The handle 34 is anchored in holes 37 formed in the flange 28. The handle permits installation of the throat liner from the exterior of the compartment in a manner which will be explained in detail below.

The protector 10 also has a short liner shown generally at 38. The short liner includes an annular, axial ferrule 40 connected to a radial collar 42. The ferrule has a draft oppositely directed from the draft of skirt 22. That is, the interior or free end of the ferrule 40 has a smaller diameter than the exterior or collar end. Thus, the short liner has an decreasing internal diameter toward the interior of the compartment. The skirt, on the other hand, has an increasing external diameter as it extends toward the interior of the car. This is referred to herein as reverse draft.

The ferrule 40 defines a central opening having an internal diameter somewhat greater than the external diameter of the first edge 24 of the skirt 22. Thus, during installation the short liner 38 fits down over the top or exterior end of the throat liner 20. The exterior diameter of the ferrule 40 is chosen to allow the ferrule to fit inside the upper end of the coaming 14. Since the ferrule and skirt have reverse draft, the ferrule will become wedged between the coaming 14 and the skirt 22 upon installation. In this position, the short liner protects the flange 15 of the coaming and also the upper edge of the coaming's axial wall. The short liner also assures a tight fit that retains the protector in the inlet opening.

Installation of the protector can be achieved by one person from the exterior of the compartment according to the following method. First, a throat liner 20 is inserted through the coaming to the interior of the car by flexing it and turning it sideways while holding onto the handle 34. Then the user releases the flexing of the throat liner and roughly aligns it so that the throat liner is coaxial with the coaming. Next the user pulls the throat liner up into the coaming by pulling on the handle 34. The throat liner is moved up into the coaming so the top of the throat liner, that is the cover 30, is roughly flush with the top of the flange 15. Holding the handle 34 in one hand, the short liner 38 is placed over the handle and then pushed into place between the coaming and the throat liner. This will be a tight fit since the parts have reverse draft. The short liner is then forced downwardly so the collar 42 engages the flange 15. Simultaneously pulling up on the rope will lock the throat liner together with the short liner in the coaming.

Once the protector is in place as described, the flange 28 and collar 42 of the protector will shield both the top flange 15 and bottom edge of the coaming. Shotblast can not impact on these parts so the maintenance operation will not result in damage to the parts. The cover 30 closes off the inlet opening so internal and external maintenance operations can be carried on simultaneously without one interfering with the other.

Whereas a preferred form of the invention has been shown and described, it will be realized that modifications could be made thereto without departing from the scope of the following claims.

What is claimed is:

1. In a container having walls defining a compartment having an interior and exterior, with an inlet opening defined by a coaming, the inlet opening extending through at least one wall and providing communication between the interior and exterior of the compartment, the coaming having at least one internal dimension between opposite sides thereof, an improved inlet opening protector, comprising:

a throat liner adapted to be placed in the inlet opening and having an annular skirt of a height at least as great as the height of the coaming, the skirt defining spaced first and second edges each having an external dimension between opposite sides thereof, the skirt being sized and tapered such that the external dimension of said first edge is less than the internal dimension of the coaming and the external dimension of the second edge is greater than the internal dimension of the coaming whereby a portion of the skirt between said edges engages the coaming when the liner is placed coaxially in the inlet opening;

a plate member connected to the skirt and extending across the annular space defined by the skirt; and a short liner having an annular ferrule and a radial collar attached to the ferrule, the ferrule defining an opening of a size permitting the first edge of the throat liner to fit through but not the second edge, the collar being engageable with the coaming when the short liner is positioned over the throat liner installed coaxially in the inlet opening.

2. The inlet protector of claim 1 further comprising a radial flange attached to the skirt adjacent the second edge and having an external dimension greater than the internal dimension of the coaming.

3. The inlet protector of claim 1 further comprising a handle means connected to the throat liner for providing a grasping element which a user can engage to manipulate the protector.

4. The inlet protector of claim 3 wherein the handle comprises a rope connected to the throat liner.

5. The inlet protector of claim 1 wherein the skirt has a frusto-conical shape.

6. The inlet protector of claim 3 wherein the handle means extends toward said first edge and the throat liner is flexible such that the throat liner can be installed from the exterior of said compartment by passing it in its entirety into to the interior of the compartment by flexing it through the inlet opening and thereafter coaxially placed in the coaming by pulling exteriorly on said handle means.

7. The inlet protector of claim 1 wherein the skirt and ferrule have reverse draft.

8. In a container having walls defining a compartment having an interior and exterior, with an inlet opening defined by a coaming, the inlet opening extending through at least one wall and providing communication between the interior and exterior of the compartment, an improved inlet opening protector, comprising:

a throat liner having a frusto-conical skirt, a flange adjacent one edge of the skirt and a plate member attached to an opposite edge of the skirt and covering the space defined by said edge, the skirt being sized to fit at least partially into the inlet opening; and a short liner having a ferrule sized to fit around the skirt portion that fits into the inlet opening and wedgingly engages itself between the coaming and skirt.

9. The inlet protector of claim 8 further comprising a radial collar attached to the ferrule and engageable with the coaming when the short liner is installed on the throat liner.

10. The inlet protector of claim 8 further comprising a handle means connected to the throat liner for providing a grasping element which a user can engage to manipulate the protector.

11. The inlet protector of claim 10 wherein the handle comprises a rope connected to the throat liner.

12. The inlet protector of claim 10 wherein the handle means extends toward said first edge and the throat liner is flexible such that the throat liner can be installed from the exterior of said compartment by passing it in its entirety into to the interior of the compartment by flexing it through the inlet opening and thereafter coaxially placed in the coaming by pulling exteriorly on said handle means.

13. The inlet protector of claim 8 wherein the skirt and ferrule have reverse draft.

* * * * *